United States Patent [19]

Miura et al.

[11] 3,945,468

[45] Mar. 23, 1976

[54] SOUND PREVENTIVE DEVICE FOR USE IN ELEVATOR

[75] Inventors: Masaki Miura, Katsuta; Ken Ichiryu, Mito; Masayuki Shigeta, Katsuta; Tadashi Shibata, Ibaraki, all of Japan

[73] Assignee: Hitachi, Ltd., Japan

[22] Filed: Dec. 11, 1974

[21] Appl. No.: 531,802

[52] U.S. Cl. ..... 187/1 R

[51] Int. Cl.[2] ..... B66B 11/02

[58] Field of Search ..... 187/1 R, 52, 56, 58, 94, 187/95; 52/30

[56] References Cited

UNITED STATES PATENTS

| | | | |
|---|---|---|---|
| 1,406,951 | 2/1922 | Fehr | 187/1 R |
| 2,300,630 | 11/1942 | Norton | 187/58 X |
| 2,463,215 | 3/1949 | Strachan | 187/95 |
| 3,051,269 | 8/1962 | Guilbert | 187/56 X |
| 3,707,205 | 12/1972 | Gibson | 187/1 R |
| 3,822,767 | 7/1974 | Lowry | 187/52 |

FOREIGN PATENTS OR APPLICATIONS

| | | | |
|---|---|---|---|
| 690,910 | 7/1964 | Canada | 187/1 R |
| 572,574 | 3/1933 | Germany | 187/1 R |
| 651,872 | 9/1937 | Germany | 187/1 R |
| 1,149,995 | 1/1958 | France | 187/1 R |
| 1,474,030 | 3/1967 | France | 187/1 R |

*Primary Examiner*—John J. Love
*Assistant Examiner*—James L. Rowland
*Attorney, Agent, or Firm*—Craig & Antonelli

[57] ABSTRACT

A sound preventive device for use in an elevator including: a skirt extending from the lower edge of the sill of a cage of an elevator and having a length greater than the difference between the height of the floor and the height of the cage and a width substantially the same as that of the cage; and guide plates which extend upwards and downwards respectively from the rear plate of the cage, the aforesaid guide plates having widths substantially the same as that of the rear plate, whereby abrupt changes in air developing above and below the cage may be minimized by means of the skirt and guide plates.

5 Claims, 15 Drawing Figures

SOUND PREVENTIVE DEVICE FOR USE IN ELEVATOR

This invention relates to a sound preventive device for use in an elevator, and more particularly to a sound preventive device for use a high speed elevator.

Recently, in line with the advent of the skyscraper, the speed of an elevator used therein is increased to as high as 360 m/min to 540 m/min.

Such an increase in the speed of an elevator results in abrupt changes in air pressures above and below a cage of an elevator, as will be described in more detail hereinafter, and thus such abrupt changes in air pressure bring about lateral oscillation of a cage and hence vibration and sounds.

It is accordingly an object of the present invention to provide a vibration and sound preventive device for use with a cage of an elevator, which device prevents lateral oscillation and hence vibration and sound developing in the cage due to changes in air pressure, by controlling or suppressing the abrupt changes in air pressures which develops above and below the cage.

It is another object of the present invention to provide a sound preventive device for use in an elevator which device effectively prevents turbulence of air, thereby presenting a comfortable high speed elevator.

It is a further object of the present invention to provide a sound preventive device which prevents turbulence of air and permits ready manufacture of the device.

According to the present invention, there is provided a sound preventive device for use in an elevator, comprising: a skirt extending from the sill of a cage of an elevator and having a length greater than the difference between the height of the floor and the height of the cage and a width substantially the same as that of the cage; and guide plates which extend upwards and downwards respectively from the rear plate of the cage, the aforesaid guide plates having widths substantially the same as that of the rear plate.

These and other objects and features of the present invention will be apparent from a reading of the ensuing part of the specification in conjunction with the accompanying drawings which indicate the preferred embodiments of the invention.

Figure 1:
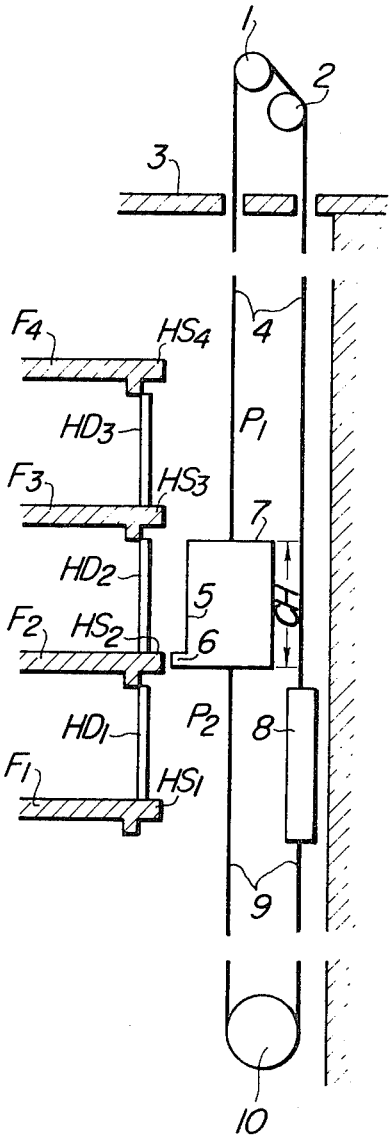
FIG. 1 is an outline showing a side view, in cross section, of an elevator and its travelling paths.
Figure 2:
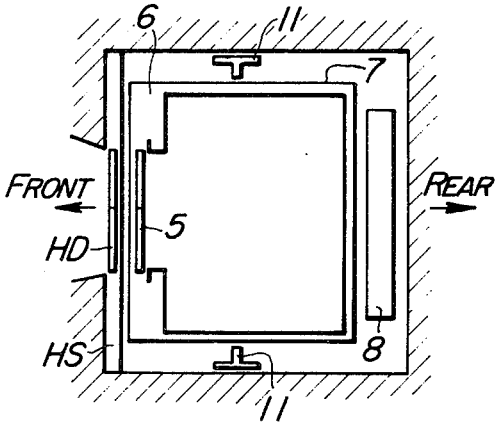
FIG. 2 is a plan view, in cross section, of the elevator of FIG. 1.
Figure 3A:
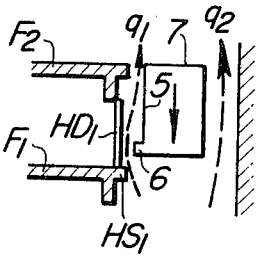
Figure 3B:
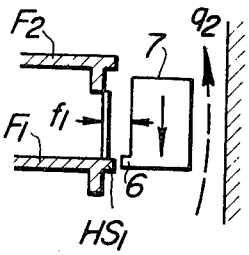
Figure 4A:
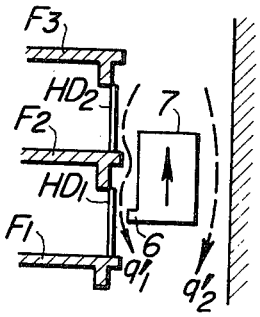
Figure 4B:
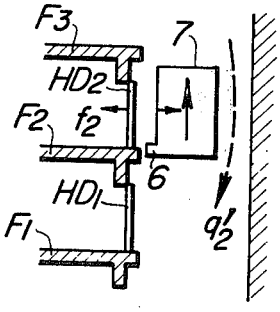
Figure 5:
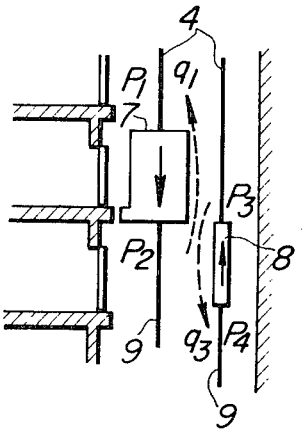
Figure 6:
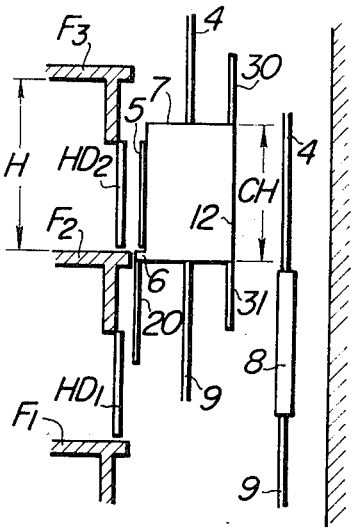
Figure 7:
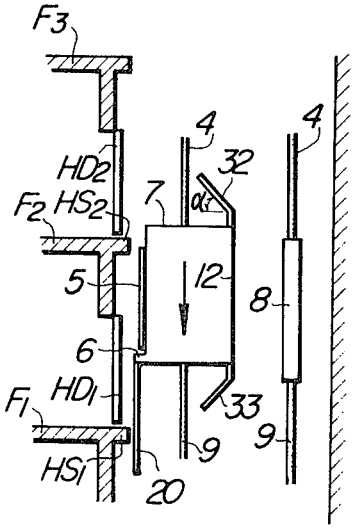
Figure 8:
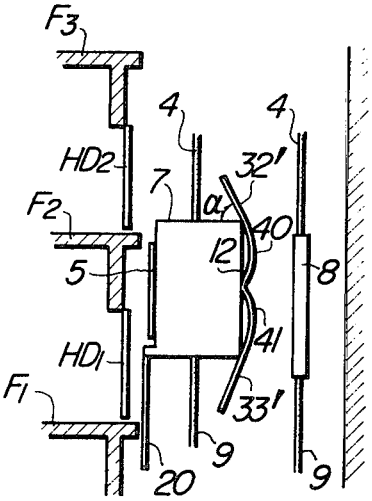
Figure 9:
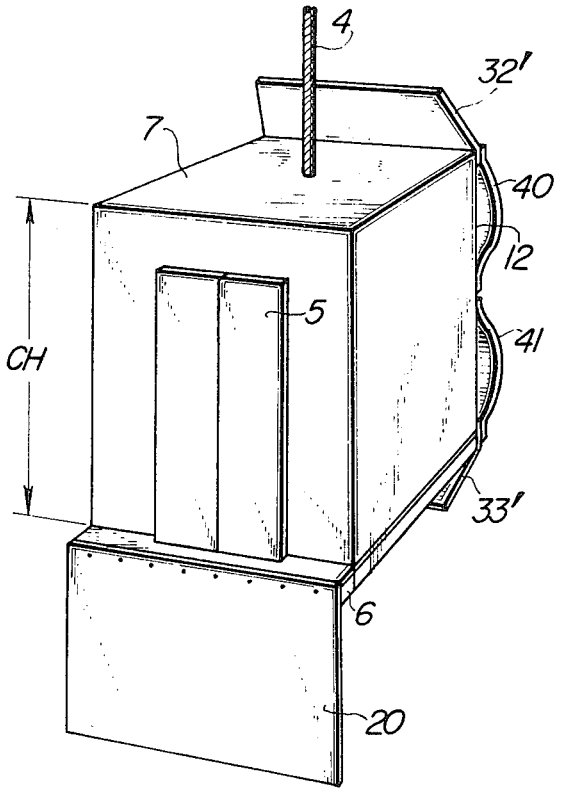
Figure 10A:
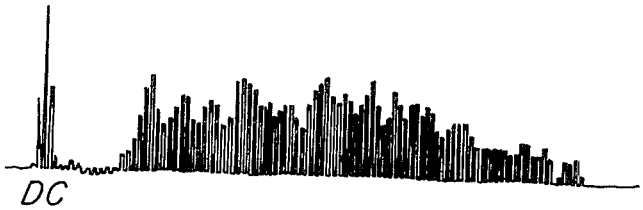
Figure 10B:
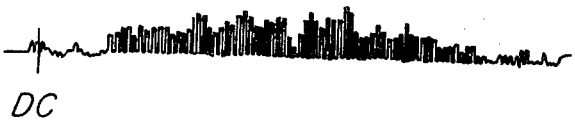
Figure 10C:
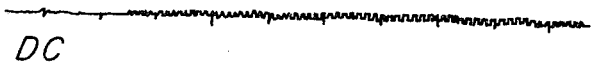
Figure 11:
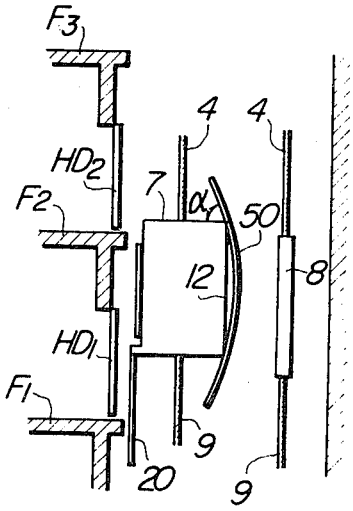

FIGS. 3*a* and 3*b* are views illustrating the changes in air streams at the time of the cage descending;

FIGS. 4*a* and 4*b* are views illustrating changes in air streams at the time of the cage ascending;

FIG. 5 is a view illustrating the change in air streams at the time of the cage descending relative to the counterweight of the elevator;

FIG. 6 is an outline showing the cage of an elevator, which cage is provided with a sound preventive device embodying the present invention, and its travelling paths;

FIG. 7 is an outline showing another embodiment of the present invention;

FIG. 8 is an outline showing a further embodiment of the invention;

FIG. 9 is an overall perspective view of the elevator shown in FIG. 8;

FIGS. 10*a*, 10*b* and 10*c* are graphs showing the power of turbulent streams of air; and FIG. 11 is a side view, in cross section, of the cage which represents a still further embodiment of the invention.

DETAILED DESCRIPTION OF THE INVENTION

Description will now be given of the lateral oscillation and the resulting vibration and sounds developing in a cage of an elevator, in conjunction with FIGS. 1 to 4. A sheave 1 of a winch and a direction-deflecting pulley 2 are located on the floor 3 of a machine room; while a main rope 4 is trained around the sheave 1 and direction-deflecting pulley 2, with one end of the main rope 4 being connected to a cage 7 and with the other end thereof being connected to the top portion of a counterweight 8. F1 to F4 represent the floors, on which are formed floor sills HS1 to HS4 as well as floor doors HD1 to HD4. On the other hand, a cage door 5 and a cage sill 6 are provided on the cage 7. Trained around the direction-changing pulley 10 located below in the ascending and descending paths is a compensating rope 9, one end of which is connected to the cage 7 and the other end of which is connected to the lower portion of the counterweight 8. Shown at 11 are guide rails for use with the cage 7, and the guide rails 11 engage guide rollers (not shown) provided on the cage 7 to thereby guide the cage 7.

In case the cage 7 descends at a high speed, the pressure P1 in the space above the cage 7 is reduced to below atmospheric pressure, while the pressure P2 in a space below the cage 7 is increased to above atmospheric pressure, thereby presenting changes in air pressures between the two, so that air streams are created around the cage 7. This developes oscillation, vibration and sounds in cage door 5, cage 7, and floor door HD.

More particularly, when the cage sill 6 passes through the midpoint between the floor F2 and F1, there are created air stream q1 along the front surface of the cage 7 and an air stream q2 in the rear of the cage 7, as shown in FIG. 3*a*. When the cage further descends, until the floor sill HS1 faces the cage sill 6, as shown in FIG. 3*b*, the air stream q1 is interrupted by the floor sill HS1 and cage sill 6, so the air stream is diminished abruptly. In other words, as shown in FIG. 3*a* in which the floor sill HS1 does not face the cage sill 6, pressure in front of the cage is somewhat higher than atmospheric pressure, while the pressure in front of the cage, when the floor sill HS1 faces the cage sill 6, is reduced to below atmospheric pressure, so that the floor door HD1 and cage door, and cage 7 receive a force shown by an arrow f1.

This then causes lateral oscillation in the floor door HD1, cage door 5 and cage 7, thus producing sound and vibration. Such sound and vibration will be increased as the speed of an elevator is increased.

FIGS. 4*a* and 4*b* show air-pressure changes at the time of the cage ascending. When the cage passes through the mid portion between the floor F2 and floor F1 as shown in FIG. 4*a*, there are created an air stream q1′ in front of the cage and an air stream q2′ in the rear thereof. However, when the cage sill 6 comes to the position to face the floor sill, the air stream q1′ is interrupted, so the pressure between the floor door HD2 and cage door 6 is increased to above atmospheric pressure, and thus the floor door HD2, cage door 6 and cage 7 receive a force shown by an arrow f2. This causes vibration and sound as in the previous case.

On the other hand, as shown in FIG. 5, when the cage 7 is descending, the pressure P1 above the cage is reduced to below atmospheric pressure due to the air stream q1, while the pressure P2 below the cage 7 is increased to above the atmospheric pressure. Conversely, the pressure P3 above the counterweight 8 is increased to above atmospheric pressure due to the air stream q3, while the pressure P4 below the counterweidht 8 is reduced to below the atmospheric pressure. As a result, when the cage 7 and counterweight 8 pass by each other, the both air pressures are increased and the direction of the air stream q1 above the cage 7 becomes opposite to that of the air stream q3 along the counterweight 8, so that there is created turbulence in the air stream, thus causing the so-called turbulent sound. The turbulent sound becomes an impulsive sound when the speed of the elevator is increased, and the impulsive sound is transmitted to the cage.

This phenomenon is also created at the time of the cage ascending.

The present invention is directed to solving the problems in the aforesaid cage and floors as well as the cage and counterweight.

In details, as shown in FIG. 6, there are provided on the lower portion of the cage sill 6 a skirt 20 having a length longer than the difference between the height of the floor and the height CH of the cage and a width substantially the same as that of the cage, and guide plates 30 and 31 extending upwards and downwards, respectively, from the rear plate 12 of the cage which passes by the counterweight 8, the guide plates 30 and 31 having widths substantaially the same as that of the rear plate 12.

The skirt 20 reaches at its tip the floor sill HS1 of the lower floor, before the cage passes the floor sill HS1, upon descending of the cage 7, so that the air stream q1 in front of the cage is gradually reduced in amount due to the passage of the skirt 20, thereby preventing the abrupt decrease in the air pressure prevailing between the floor door HD1 and the cage door 5, when the cage sill 6 comes to the position to face the floor sill HS1, with the resulting reduction in vibration and sound. At the time of cage ascending as well, the air stream q1′ is gradually reduced in amount to thereby prevent an abrupt increase in air pressure prevailing between the floor door HD2 and the cage door 5, when the cage sill 6 comes to the position to face the floor sill HS2 with the resulting reduction in vibration and sound.

On the other hand, the pressure change in the rear of the rear plate may be neutralized by means of guide plates 30, 31, and also turbulence is created in the rear of the guide plates 30, 31 on the side of the counterweight, so that the turbulent sound within the cage 7 is reduced. In other words, the air turbulence having developed above and below the rear plate of the cage as in the conventional type cage are created in the neighborhood of the positions above and below the guide plates 30, 31, so that propagation of turbulent sound to the cage 7 may be neutralized by averting the sound source away from the cage 7.

FIG. 7 shows another embodiment of the present invention, in which there are shown guide plates 32, 33 which are bent in the direction opposite to the counterweight 8 for facilitating the smooth flowing of the air stream q2 around the cage, the aforesaid guide plates 32, 33 extending from the upper and lower edges of the rear plate. The provision of the guide plates 32, 33 thus bent may prevent the turbulence of air stream q2, with reduction in turbulent sound. In this case, the angle ($\alpha$) of the bent guide plate should preferably fall in the range from 30° to 60° and the length of the guide plates should be above 40 cm, in the light of the results of experiments.

FIG. 8 shows a still further embodiment of the invention, in which the edges of the guide plates 32′, 33′ on the side of the cage are coupled by means of streamlined subsidiary guide plates 40, 41 to the cage rear plate 12.

The provision of the subsidiary guide plates 40, 41 facilitates the smooth flowing of the air stream q2 around the cage 7, thus reducing turbulence to a great extent. FIG. 9 is an overall perspective view of the cage portion shown in FIG. 8.

FIG. 10 refers to the magnitudes of power of air turbulence, i.e., swirls along the rear plate 12, at the time of operation of a cage at a speed of 540 m/min; in which FIG. 10*a* is a case of the cage having no guide plates, FIG. 10*b* is a case of the cage provided with guide plates 30, 31 of FIG. 6, and FIG. 10*c* is a case of the cage provided with subsidiary guide plates 40, 41 of FIG. 9. As is apparent from this figure, there develops an extremely large turbulence in the absense of guide plates, while in the case of the presence of the guide plates 30, 31, the magnitude of turbulence is reduced to half. In addition, there develops little turbulence owing to the provision of subsidiary guide plates 40, 41. This signifies that the energy to vibrate the rear plate 12 is reduced.

FIG. 11 is a view showing an embodiment in case the guide plates 32′, 33′ are integral with the subsidiary guide plates 40, 41 to thereby form a integral guide plate 50. Such an arrangement may save the attaching operation of the guide plates to the auxiliary guide plates, thus providing readiness in manufacture.

What is claimed is:

1. In an elevator having a counterweight and a cage with a rear plate and a cage sill for guiding a movable cage door, the cage and counterweight being suspended from opposite ends of a main rope and adapted to ascend and descend at high speeds in opposite directions such that the rear plate passes closely adjacent to the counterweight, wherein the improvement comprises a skirt extending from the lower edge of the cage sill and having a length greater than the difference between the height of a floor and the height of the cage, said skirt having a width substantially the same as that of said cage, and guide plates extending upwardly and downwardly from the rear plate and having widths substantially the same as that of said rear plate.

2. In an elevator according to claim 1, wherein said guide plates are inclined in a direction opposite to the counterweight.

3. In an elevator according to claim 2, wherein the length of said guide plates is longer than 40 cm., and said guide plates are inclined at an angle of from 30° to 60°.

4. In an elevator according to claim 2, wherein streamlined subsidiary guide plates couple the edges of said inclined guide plates to the rear plate.

5. In an elevator according to claim 4, wherein said guide plates and said subsidiary guide plates form an integral guide plate.

* * * * *